US012774183B2

(12) United States Patent
Fritz

(10) Patent No.: US 12,774,183 B2
(45) Date of Patent: Oct. 27, 2026

(54) WORKPIECE CARRIER, TRANSPORT SYSTEM WITH SEVERAL SUCH WORKPIECE CARRIERS, AND USE FOR THE SEPARATION OF WORKPIECES, IN PARTICULAR IN BATTERY PRODUCTION

(71) Applicant: GROB-WERKE Gmbh & Co. KG, Mindelheim (DE)

(72) Inventor: Alexander Fritz, Schiessen (DE)

(73) Assignee: GROB-WERKE Gmbh & Co. KG, Mindelheim (DE)

( * ) Notice: Subject to any disclaimer, the term of this patent is extended or adjusted under 35 U.S.C. 154(b) by 246 days.

(21) Appl. No.: 18/648,035

(22) Filed: Apr. 26, 2024

(65) Prior Publication Data

US 2024/0359943 A1 Oct. 31, 2024

(30) Foreign Application Priority Data

Apr. 27, 2023 (DE) ..... 102023110843.3
Jul. 7, 2023 (EP) ..... 23184279

(51) Int. Cl.
*B65H 5/22* (2006.01)
*B25B 11/00* (2006.01)
(Continued)

(52) U.S. Cl.
CPC ..... *B65H 35/06* (2013.01); *B65H 2406/33* (2013.01); *B65H 2406/344* (2013.01); *B65H 2406/423* (2013.01)

(58) Field of Classification Search
CPC ..... B25B 11/005; H01M 10/04; H01M 4/04; B65H 2406/33; B65H 2406/344;
(Continued)

(56) References Cited

U.S. PATENT DOCUMENTS 10,381,256 B2 * 8/2019 Subrahmanyan ..... H10P 72/78
2015/0018188 A1 1/2015 Jamar et al.
(Continued)

FOREIGN PATENT DOCUMENTS

DE 202014004053 U1 9/2014
DE 102017216213 A1 3/2019
(Continued)

OTHER PUBLICATIONS

English Translation of JP 2018-152447 A (Year: 2026).*
European Search Report for European Patent Application No. 23184279.0 dated Jan. 5, 2024.

*Primary Examiner* — Luis A Gonzalez
(74) *Attorney, Agent, or Firm* — Greer, Burns & Crain, Ltd.

(57) ABSTRACT

A workpiece carrier for taking over, transporting and transferring a workpiece formed as a segment of a material web, with a support surface formed on a carrier body for placing the workpiece on, and a suction device for sucking the workpiece onto the support surface, wherein the suction device has at least one movable suction nozzle which projects from the support surface in the rest position and, when subjected to vacuum, is configured to be moved against a force holding the suction nozzle in the rest position into a retracted position in which the suction nozzle does not project beyond the support surface.

13 Claims, 4 Drawing Sheets

Fig. 1

(51) Int. Cl.
*B65H 5/08* (2006.01)
*B65H 35/06* (2006.01)

(58) Field of Classification Search
CPC .... B65H 2406/423; B65H 5/22; B65H 5/222; B65H 5/08
See application file for complete search history.

(56) References Cited

U.S. PATENT DOCUMENTS

| | | | | |
|---|---|---|---|---|
| 2016/0163580 | A1* | 6/2016 | Huang | H10P 72/78 29/559 |
| 2021/0394340 | A1* | 12/2021 | Grund | B25B 11/005 |

FOREIGN PATENT DOCUMENTS

| | | | | |
|---|---|---|---|---|
| EP | 2626322 | A1 | | 8/2013 |
| JP | S4918468 | U | | 2/1974 |
| JP | 03012948 | A | * | 1/1991 |
| JP | 10086086 | A | * | 4/1998 |
| JP | 2018152447 | A | * | 9/2018 |
| WO | 2020192845 | A1 | | 10/2020 |

* cited by examiner

WORKPIECE CARRIER, TRANSPORT SYSTEM WITH SEVERAL SUCH WORKPIECE CARRIERS, AND USE FOR THE SEPARATION OF WORKPIECES, IN PARTICULAR IN BATTERY PRODUCTION

CROSS-REFERENCES TO RELATED APPLICATIONS

This application claims the benefit of German Patent Application Number 10 2023 110 843.3 filed on Apr. 27, 2023, and European Patent Application Number 23 184 279.0 filed on Jul. 7, 2023, the entire disclosures of which are incorporated herein by way of reference.

FIELD OF THE INVENTION

The invention relates to a workpiece carrier for taking over, transporting and transferring a workpiece formed as a segment of a material web. The invention also relates to a transport system comprising a guide track and several of the workpiece carriers. The invention also relates to the use of such a workpiece carrier in the production of electrodes for a battery cell. The invention also relates to an automatic separating method, in particular computer-controlled, for separating flat workpieces from a material web using such a workpiece carrier and to a separating device designed for performing the separating method. Finally, the invention relates to a computer program with instructions for performing the separating method.

BACKGROUND OF THE INVENTION

Preferred embodiments of the invention relate to the field of material handling and more particularly to a system and a method for taking over a web-shaped workpiece, subsequent separation and transfer of the workpiece to a transport device, preferably in the form of a rotating vacuum drum, for further processing in a continuous process.

For the technological background, reference is made in particular to the following literature:

[1] WO 2020/192 845 A1

[2] DE 20 2014 004 053 U1

Methods and apparatuses for the provision of electrode strings and for the production of mono cells and battery stacks formed from them are known from [1]. In particular, [1] describes a system for the production of battery cells, in which an anode string with anodes (A) attached to a first web-shaped separator (S) and a cathode string with cathodes (K) attached to a second web-shaped separator (S) are provided as electrode strings from which a string composite is formed from which mono cells are separated. For this purpose, the electrodes are separated from a web-shaped electrode substrate and laminated on a separator web. Precise positioning of the electrodes is important in this case.

Movable suction nozzles in the form of vacuum suction nozzles are known from literature [2] and are used for handling lids for yoghurt pots.

SUMMARY OF THE INVENTION

The invention is based on the problem of providing solutions for a positionally precise takeover, transport and transfer of a workpiece formed as a segment of a material web, such as an electrode segment.

To solve this problem, the invention provides a workpiece carrier according to one or more embodiments described herein. A transport system with several such workpiece carriers, a use of the workpiece carrier in battery cell production and a method and apparatus for separating workpieces using such a workpiece carrier as well as a computer program with corresponding control instructions are also described herein.

According to one aspect, the invention provides a workpiece carrier for taking over, transporting and transferring a workpiece formed as a segment of a material web, the workpiece carrier having a support surface formed on a carrier body for placing the workpiece on and a suction device for sucking the workpiece onto the support surface, wherein the suction device has at least one movable suction nozzle which in the rest position projects from the support surface and when subjected to vacuum can be moved into a retracted position, from which the suction nozzle does not project beyond the support surface, against a force holding the suction nozzle in the rest position.

In some embodiments, to form the movable suction nozzle, an attachment region of an elastic nozzle body or a nozzle body consisting of several parts (e.g. telescopic) is firmly attached to the carrier body, so that the nozzle opening can move in itself due to the movability of the suction nozzle. The term "movable suction nozzle" therefore includes designs in which the suction nozzle is movably attached to the carrier body or also designs in which the suction nozzle is movable in itself, e.g., by being formed from an elastic material.

It is preferred that the suction device has at least one first air circuit with at least one first suction nozzle for sucking the workpiece onto the support surface and a second air circuit with at least one second suction nozzle for sucking the workpiece onto the support surface, the first and second air circuits being controlled differently.

It is preferred that the at least one first suction nozzle is designed as a first movable suction nozzle and/or that the at least one second suction nozzle is designed as a second movable suction nozzle.

It is preferred that the at least one first suction nozzle is arranged upstream of the at least one second suction nozzle in the transport direction.

It is preferred that the first air circuit has a first air chamber in the carrier body, at least one first movable suction nozzle being connected to the first air chamber, and that the second air circuit has a second air chamber in the carrier body, at least one second movable suction nozzle being connected to the second air chamber.

It is preferred that the first air chamber has a first air connection at the side or on the side of the carrier body opposite the support surface and that the second air chamber has a second air connection at the side or on the side of the carrier body opposite the support surface.

It is preferred that the air connections of the first and second air circuits are offset from each other in the transport direction.

It is preferred that the workpiece carrier is designed as a transport unit of a transport system comprising individually movable transport units. In particular, the movement of the individual transport units can be controlled individually. Such transport systems with individually controllable movable transport units are generally known (e.g., a Beckhoff XTS, a so-called mover system with freely displaceable movers, or a transport system from B&R Supertrack).

According to a further aspect, the invention also provides a transport system comprising a guide track and several workpiece carriers according to any one of the preceding embodiments, which workpiece carriers are individually movable along the guide track as transport units. In particular, the transport system is computer-controlled and configured to move the transport units in an individually controlled manner.

According to a further aspect, the invention provides the use of a workpiece carrier according to any one of the preceding embodiments in the production of electrodes for a battery cell.

According to a further aspect, the invention provides a separating apparatus for separating flat workpieces from a material web, the separating apparatus comprising a feeding device for feeding the material web, a cutting device for cutting the material web to obtain the workpieces, a vacuum drum for the removal of the workpieces and a series of workpiece carriers according to any one of the above embodiments or a transport system of the above-described design with the workpiece carriers as individually movable transport units, and a computer-implemented control system controlling the workpiece carriers for taking over the material web, transporting the material web through the cutting device and transferring the workpieces onto the vacuum drum.

According to a further aspect, the invention provides a separating method for separating flat workpieces from a material web, comprising:

a) providing the material web, b) picking up the material web by means of a plurality of workpiece carriers successively moved in a transport direction, according to any one of claims 1 to 8, wherein first a vacuum is applied to a movable suction nozzle which is leading in the transport direction and then a vacuum is applied to a movable suction nozzle which is trailing in the transport direction, c) transporting the workpiece carriers having the material web sucked to them through a cutting device and cutting the material web between two successive workpiece carriers, in order to separate segments of the material web lying on the workpiece carriers to form workpieces;

d) transferring the workpieces to a vacuum drum for removal, wherein first a movable suction nozzle which is leading in the transport direction is switched to a vacuumless state and then a movable suction nozzle which is trailing in the transport direction is switched to a vacuumless state.

Preferably, step d) comprises the step:

d1) counter-blowing by the suction nozzle switched to the vacuumless state in order to shorten the transfer time for transferring the workpiece.

Preferably, step d) comprises the step:

d2) applying the workpiece against the vacuum roller using the force holding the respective suction nozzle in the rest position as restoring force.

Preferably, step d) comprises the step:

d3) applying a restoring force of the respective suction nozzle to the workpiece to press the workpiece against the vacuum roller to prevent a loss of position during transfer.

According to a further aspect, the invention provides a use of the separating apparatus or the separating method according to any one of the preceding embodiments in the production of battery cells, in particular for separating electrodes from an electrode web.

According to a further aspect, the invention provides a computer program comprising instructions that cause the separating apparatus to perform the separating method.

Preferred embodiments of the invention relate to a unit for taking over electrode webs and transferring straight sheets to a rotating vacuum roller.

In preferred embodiments of the invention, the property of special vacuum suction nozzles—an example of movable suction nozzles—is utilized to compensate for thickness tolerances and manufacturing tolerances. In addition, the workpiece, for example an electrode, can be transferred to a round drum without damage and without great effort, whereas a transfer between flat webs and round elements has been particularly challenging up to now. Transferring a web-shaped element onto a passing product carrier has also been a challenge to date.

Material handling by conventional product carriers with integrated vacuum bores and without other integrated assemblies frequently results for example in the web tearing off from the product carrier during the transfer of an electrode web and requires a complex mechanical follow-up of the product carrier at the vacuum drum for the transfer of the separated web sections, which is costly and complicated to create.

Advantageous embodiments of the invention have the function of implementing the takeover and handover (transfer) of webs and web sections of different thicknesses in such a way that changes in the thickness of the material web, e.g., electrode web, as well as, manufacturing tolerances on the components involved are compensated for and the transfer process works under different process parameters.

For this purpose, according to advantageous embodiments of the invention, a workpiece carrier is provided which has movable or flexible nozzles for sucking the workpiece onto the workpiece carrier.

According to some advantageous embodiments of the invention, at least two separate air circuits are incorporated into a cassette to be moved or a workpiece carrier to be moved. Depending on the product size, varying numbers of flexible or movable nozzles or suction nozzles are connected to these air circuits.

The air circuits are preferably activated at staggered intervals so that the web to be transported and separated if necessary is slowly detached from the feed device in the first step by sucking the web as the cassette/workpiece carrier moves past a feeding device.

Preferably, a vacuum is first applied to the leading air circuit and then, after a time interval, to the trailing air circuit(s).

Preferably, the suction nozzles (flexible/movable nozzles) installed in the cassette/workpiece carrier contract due to the contact with the web when the vacuum is activated and terminate flush with the support of the cassette/workpiece carrier. Thus the web lies flat on the surface.

The workpiece carrier/cassette is preferably transported further with the web sucked to it, followed in some embodiments by the separation of the sucked web section. The now separated workpiece is moved to a transfer point.

Here, the vacuum in the leading air circuit is removed, the suction nozzles return to their original position and urge the web section onto a transport device, e.g., a vacuum roller, for further processing. By maintaining the vacuum in the trailing air circuit, the web remains fixed and does not lose position during transfer, as the web is fixed, in particular sucked, to the product carrier/cassette and transport device (drum/vacuum roller) at the same time.

The vacuum is removed at time intervals in all chambers.

The benefits of preferred embodiments of the invention are that in contrast to a pick-up via vacuum bores in the cassette/product carrier, the stroke of the suction nozzles can be used to compensate for possible tolerances and different material thicknesses.

The extension of the suction nozzles ensures a transfer without loss of position at the moment of transfer, as the workpiece can be transferred to the transport device, e.g., vacuum drum, without damage and is not in a suspended state at any time.

This means that monitoring systems and position correction can be omitted from the design.

The same applies in reverse order for the takeover of the (electrode) web from a feeding device.

Furthermore, the handovers and takeovers work with consistent quality, even if the speed is adjusted, for example, as the air circuits can be activated in a position-controlled manner.

BRIEF DESCRIPTION OF THE DRAWINGS

Exemplary embodiments are described in more detail below with reference to the attached drawings in which.

DETAILED DESCRIPTION OF THE PREFERRED EMBODIMENTS

Figure 1:
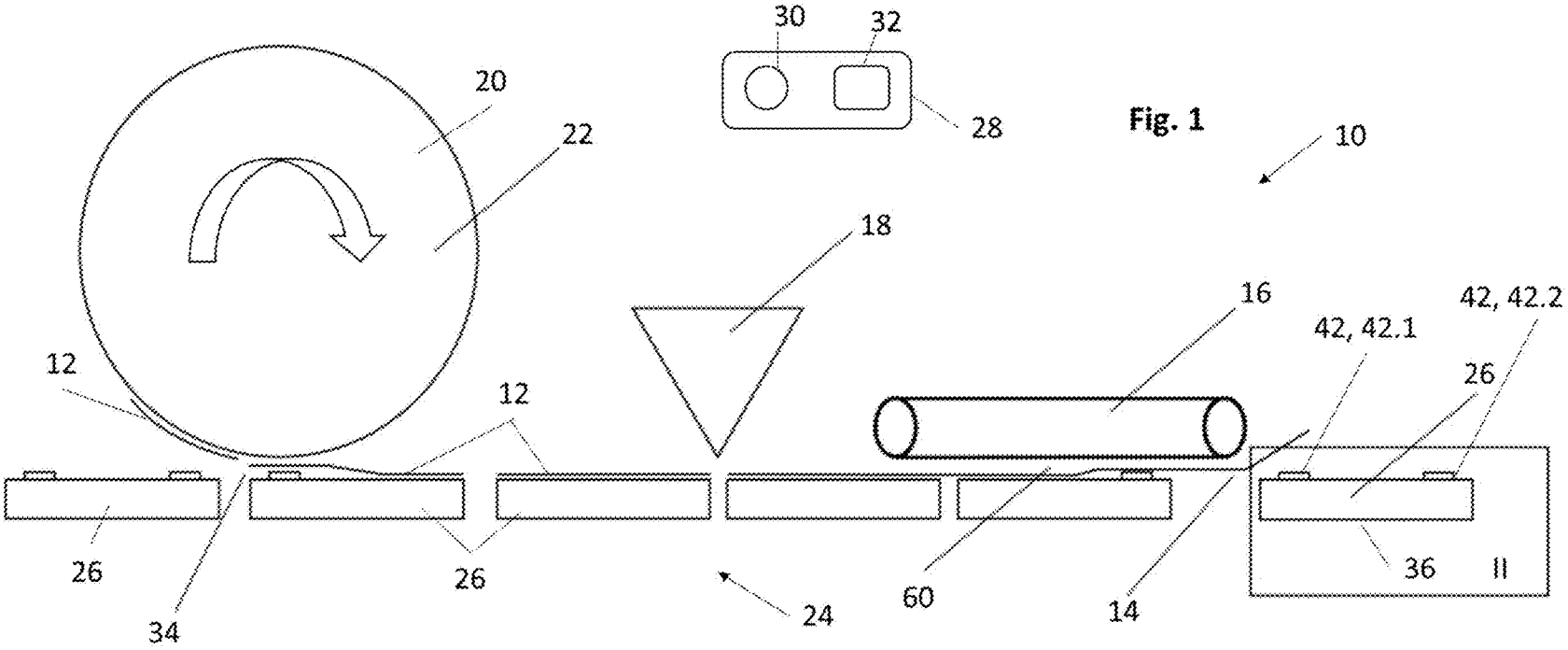
FIG. 1 is a schematic lateral overview of an embodiment of a separating apparatus with a transport system having individually movable transport units in the form of workpiece carriers for taking over, transporting and transferring a workpiece in the form of a segment of a material web.

FIG. 1 shows a schematic view of a possible embodiment of a separating apparatus 10 for separating flat workpieces 12 from a material web 14.

The separating apparatus 10 can for example be part of a manufacturing system for battery cells (see document [1] for example) and is used for instance to separate electrodes such as anodes or cathodes from a web-shaped electrode substrate. The separated electrodes can then be further processed, e.g., laminated onto a separator web to form an electrode string, or combined with a separator web for instance to form a battery cell stack by Z-folding or the like.

The separating device 10 has a feeding device 16 for feeding the material web 14, a cutting device 18 for cutting the material web 14 in order to obtain the workpieces 12, a transport device 20, in this case in particular in the form of a vacuum drum 22, for removing the workpieces 12, and a transport system 24 with individually movable transport units in the form of workpiece carriers 26 as well as a computer-implemented controller 28 which controls the workpiece carriers 26 for taking up the material web 14, transporting it through the cutting device 18 and transferring the workpieces 12 to the vacuum drum 22.

The controller 28 includes a processor 30 and a memory 32 having stored therein a computer program with control instructions.

The cutting device 18 includes for example a cutting laser (not shown) controlled by the controller 28.

The transport system 24 has a circulating guide track (not shown) for the transport units designed as workpiece carriers 26, the movement of which can be controlled individually in accordance with a desired process sequence. The basic structure for such a transport system 26 is generally known (e.g., the Beckhoff XTS transport system) and is available on the market.

The vacuum drum 22 has suction openings on its circumferential surface. By applying a vacuum inside the vacuum drum 22, the flat workpieces 12 can be picked up at a transfer point 34 from the respective workpiece carrier 26 and fixed on the circumferential surface for removal.

In the following, advantageous embodiments of the workpiece carrier 26 are explained in more detail with reference to the illustrations in FIGS. 2 to 7.

The workpiece carrier 26 is designed to take over, transport and transfer the workpiece 12, which is formed as a segment of the material web 14. The workpiece carrier 26 has a carrier body 36, a support surface 38 formed on the carrier body 36 for supporting the workpiece 12, and a suction device 40 for sucking the workpiece 12 onto the support surface 38. The suction device 40 has at least one movable suction nozzle 42 (also called suction nozzle).

The suction nozzle 42 protrudes from the support surface 38 in the rest position.

Figure 5:
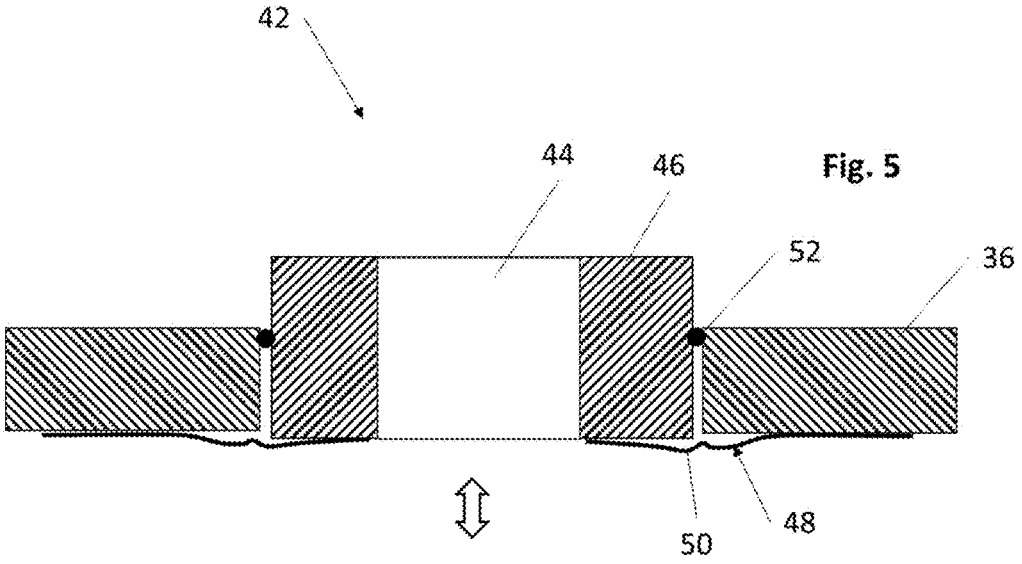
FIG. 5 is a schematic section through a movable suction nozzle of the workpiece carrier in a first embodiment.
Figure 6:
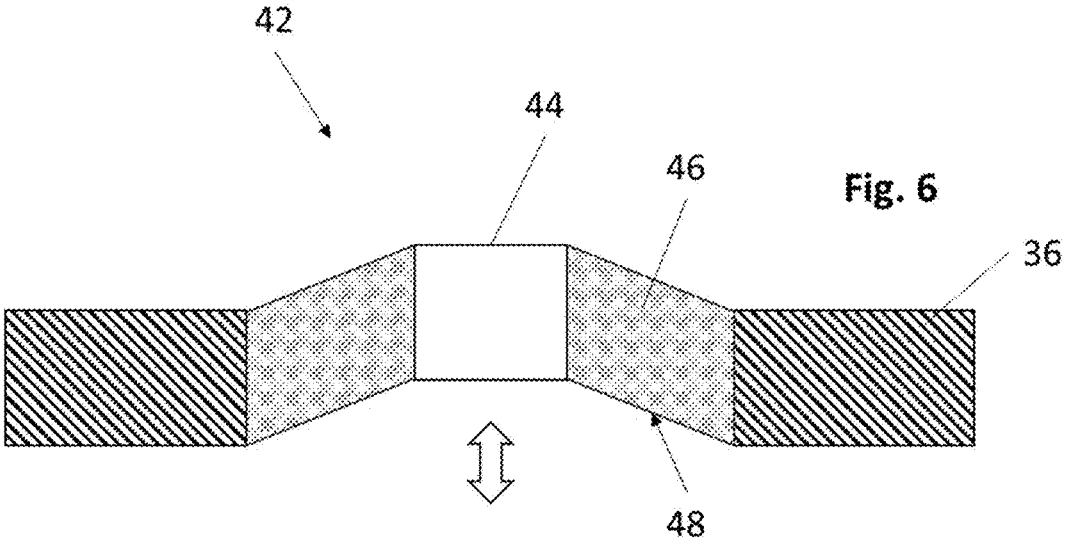
FIG. 6 is a schematic section through a movable suction nozzle of the workpiece carrier in a second embodiment.
Figure 7:
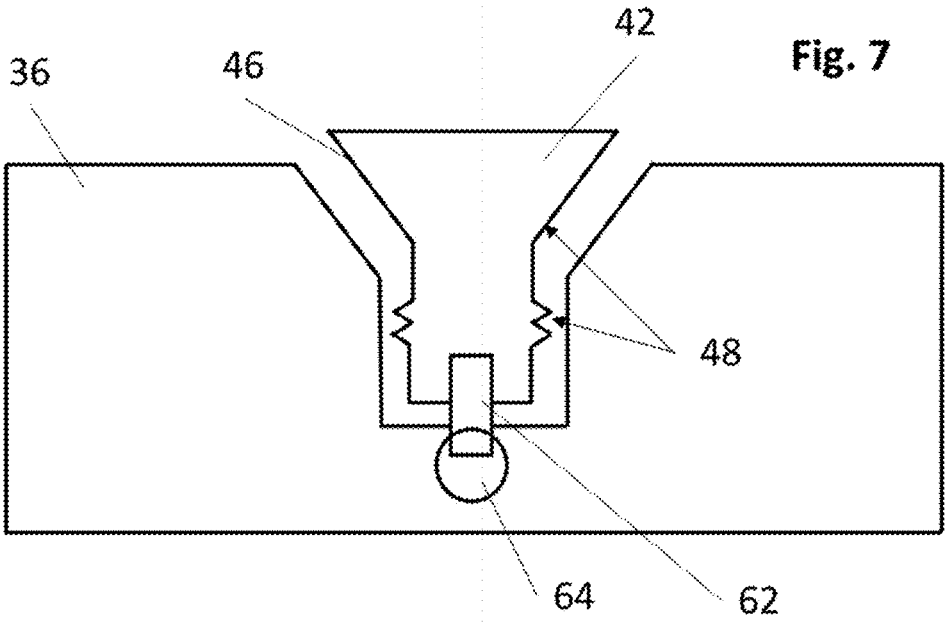
FIG. 7 is a schematic section through a movable suction nozzle of the workpiece carrier in a third embodiment.

Possible embodiments of the suction nozzle 42 are illustrated in FIGS. 5 to 7 in the respective rest position.

The suction nozzle 42 has a nozzle opening 44 with a movable boundary 46 that is urged into the rest position by a force accumulator 48, such as a mechanical spring or an elastic material, such as in particular a membrane or a bellows design or the like.

In the embodiment shown in FIG. 5, the boundary 46 is formed by a telescopically movable ring element which is pre-loaded into the rest position by a diaphragm spring 50 as a force accumulator 48. The diaphragm spring 50 can also be designed as a gasket; alternatively or additionally, further gaskets 52 can be provided. Instead of the diaphragm spring 50, other springs such as compression springs or tension springs can also be provided.

Accordingly, in some embodiments, the suction nozzle 42 as a whole is held movably on the carrier body 36 against the force of a force accumulator 48.

In the embodiment according to FIG. 6, the boundary 46 is made of elastic material, for example silicone or rubber, and is itself elastically deformable and thus movable. In particular, the boundary 46 is designed as a membrane, the outer edge of which is firmly attached to the carrier body 36.

In this case, the force accumulator 48 is formed by the material of the boundary 46 itself; alternatively or additionally, spring elements not shown, such as leaf springs or the like, can be provided in or on the boundary 46 designed as a diaphragm, which spring elements pre-load the suction nozzle 42 into its rest position shown in FIG. 6.

In the embodiment shown in FIG. 7, the suction nozzle 42 is made of an elastic material. A bellows design can be provided. The suction nozzle 42 is firmly connected to a cassette (example for carrier body 36) of the workpiece carrier 26 by a plug-in nipple 62. FIG. 7 also shows a vacuum bore 64 as an example of an air connection. When a vacuum is applied, the suction nozzle 42 is contracted and bears against the side walls 66 on the carrier body 36, thus forming a flat surface.

Accordingly, in some embodiments, a part of the movable suction nozzle 42 is fixedly connected to the carrier body 36, but the suction nozzle 42 is movable in itself due to movable elements of the suction nozzle 42 and, in particular, can be moved into a retracted position.

In all of its illustrated designs, the suction nozzle 42 can be moved into a retracted position against the force (of the force accumulator 48) holding the suction nozzle 42 in the rest position when it is subjected to vacuum. In the retracted position, the suction nozzle 42 does not protrude beyond the support surface 38.

Figure 2:
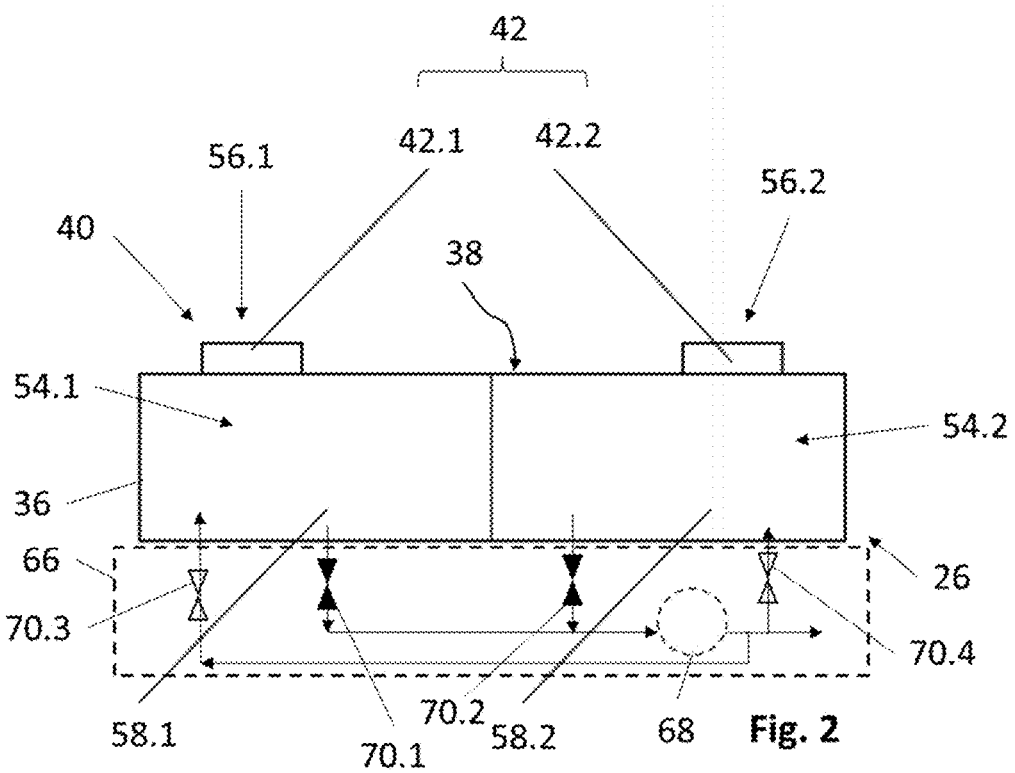
FIG. 2 is a schematic lateral view of one of the workpiece carriers without workpiece in the initial position according to detail II of FIG. 1.
Figure 3:
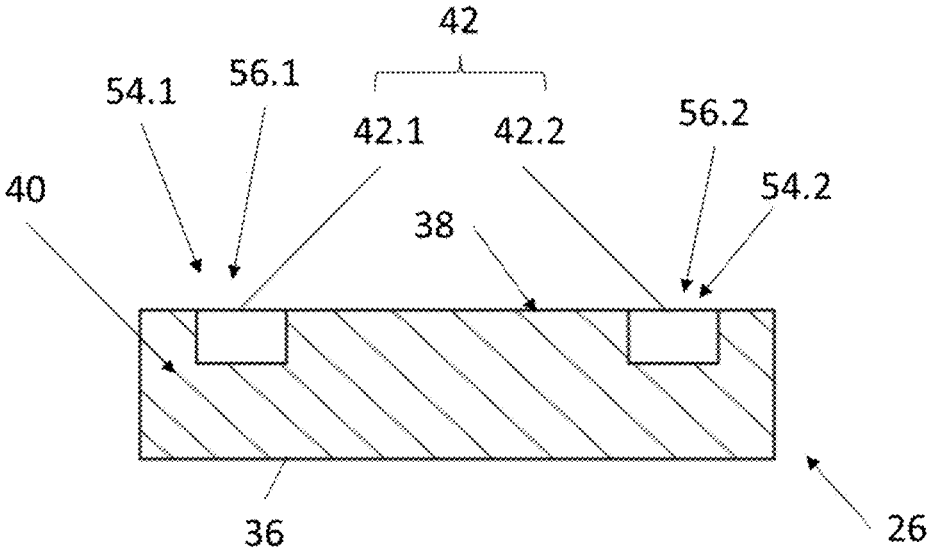
FIG. 3 is a schematic lateral sectional view of the workpiece carrier with fully activated vacuum, shown without workpiece.
Figure 4:
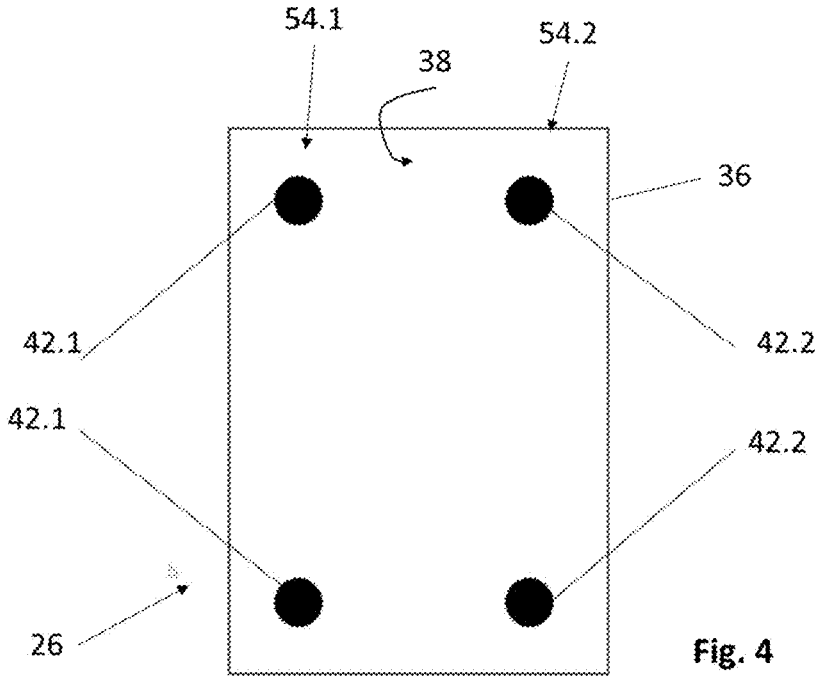
FIG. 4 is a top view of the workpiece carrier.

FIG. 2 shows the workpiece carrier 26 with several suction nozzles 42 in the rest position (vacuum deactivated). In FIGS. 3 and 4, the workpiece carrier 26 (here without workpiece 12 for illustration purposes) is roughly shown as dashed lines with the vacuum activated and with the suction nozzles 42 sucking the workpiece in the retracted position.

The workpiece carrier 26 is designed as a transport unit of a transport system. In FIG. 2, the carrier body 36, designed for example as a cassette, is arranged on a substructure 66, roughly shown as dashed lines, which is designed for movement (not illustrated) on the movement path of the transport system. As can be seen in particular in FIG. 2, the suction device 40 has at least one first air circuit 54.1 with at least one first suction nozzle 56.1 for sucking the workpiece 12 onto the support surface 38, and a second air circuit 54.2 with at least one second suction nozzle 56.1 for sucking the workpiece 12 onto the support surface 38. The first and second air circuits 54.1, 54.2 can be controlled differently.

In some embodiments, the at least one first suction nozzle 56.1 and the at least one second suction nozzle are in the form of the movable suction nozzle 42.1, 42.2. The number of movable suction nozzles 42.1, 42.2 per air circuit 54.1, 54.2 depends on the shape and dimensions of the workpiece 12. The number of air circuits 54.1, 54.2 also depends on the shape and dimensions of the workpiece; more than one air circuit arranged in succession in the transport direction can also be provided.

In the illustrated embodiment—see FIG. 4—two first movable suction nozzles 42.1 are provided as first suction nozzles 56.1, and two second movable suction nozzles 42.2 are provided as second suction nozzles 56.2.

The at least one first suction nozzle 56.1 is arranged upstream of the at least one second suction nozzle 56.2 in the transport direction.

The first air circuit 54.1 has a first air chamber 58.1 in the carrier body 36. The at least one first movable suction nozzle 42.1 is connected to the first air chamber 58.1. The second air circuit 54.2 has a second air chamber 58.2 in the carrier body 36. The at least one second movable suction nozzle 42.2 is connected to the second air chamber 58.2.

The first air circuit 54.1 further comprises a first air connection (not shown) at the side (e.g. at the side shown at the top in FIG. 4) or on the side of the carrier body 36 opposite the support surface 38 (i.e. the side shown at the bottom in FIG. 2). A negative pressure or vacuum is activated in the first air chamber 58.1 via the first air connection. The second air circuit 54.2 has a second air connection (not shown) at the side or on the side of the carrier body 36 opposite the support surface 38. A negative pressure or vacuum is activated in the second air chamber 58.2 via the second air connection.

For example, a vacuum pump 68 is arranged in this case on the substructure 66 for example, so that it moves along. The vacuum pump 68 is designed for example as a diaphragm pump. A power connection for the vacuum pump 68 is available on the transport unit. The suction side of the vacuum pump 68 can be connected to the first air chamber 58.1 by means of a first valve 70.1 that can be controlled by the controller 28. Furthermore, the suction side of the vacuum pump 68 can be connected to the second air chamber by means of a second valve 70.2 that can be controlled by the controller 28. In this manner, the vacuum in the respective air chamber 58.1, 58.2 can be activated by switching the corresponding first or second valve 70.1, 70.2.

Optionally, the discharge side of the vacuum pump 68 is connected to the first air chamber 58.1 by a third valve 70.3 that can be actuated by the control unit 28 and to the second air chamber 58.2 by a fourth valve 70.3 that can be actuated by the control unit 28.

In preferred embodiments, the volumes in the carrier body 36 are designed to be as small as possible in order to enable short times for building up or reducing the vacuum or possibly also a short overpressure. In some embodiments, a traveling vacuum accumulator (not shown), which moves along, is also provided.

In other embodiments (not illustrated), the air connections of the first and second air circuits 54.1, 54.2 are offset from each other in the transport direction. Along the guide track of the transport system shown in FIG. 1, in the section in which a vacuum is to be activated, a connection channel is located for air connections of the workpiece carrier 26 moving past the connection channel to dock, so that the air connections are connected to a suction device on the fly, in order to activate the vacuum.

FIG. 1 schematically shows the takeover and handover (transfer) processes for taking over and transferring the workpiece 12.

The workpiece carrier 26 (also called product carrier) shown on the far right in FIG. 1, with the suction nozzles 42.1, 42.2 (also called suction nozzles) extended, moves under the material web 14 (e.g., web-shaped electrode substrate or electrode web). The latter is fed by the feeding device 16.

Below the feeding device 16 a vacuum is applied to the leading air circuit (e.g. the first air circuit 54.1), whereby the material web 14 is sucked onto the workpiece carrier 26, as shown at the transfer point 60. The vacuum which is produced causes the first suction nozzle 42.1 to contract as shown in FIG. 3 and to draw the material web 14 onto the surface—support surface 38—of the workpiece carrier 26.

In the following step, the process of activating the vacuum is repeated for all downstream air circuits (e.g., the second air circuit 54.2 and all air circuits that may be present downstream of it).

At the cutting device 18, the material web 14 is cut into individual parts.

At the transfer point 34, the vacuum in the upstream air circuit (e.g. the first air circuit 54.1) is destroyed. For example, when using the embodiment shown in FIG. 2, the corresponding valve 70.1-70.4 is actuated in order to switch off the vacuum or switch to counter-blowing. The vacuum pump 68 can still continue to run in this case. As shown in FIG. 2, the vacuum pump has an exhaust air connection that is used for counter-blowing. In other embodiments, for example, the suction channel terminates at the transfer point 34, so that the first air connection is no longer docked to the suction pump or the like.

By deactivating the negative pressure/vacuum, the at least one first suction nozzle 42.1 returns to its original shape. As a result, the workpiece 12 is caused to bear against the transport device 20 without damage and is fixed to it. In the illustrated embodiment, the workpiece 12 is applied against and sucked by the vacuum drum 22. The workpiece 12 is not free-floating at any time and therefore does not lose its position.

In some embodiments, the corresponding air circuit is supplied with overpressure in order to transfer the workpiece 12 more quickly. For example, an overpressure is introduced into the air chamber 58.1, 58.2 by means of valves 70.3, 70.4. In other embodiments, a pressure connection supplied with overpressure is provided at the transfer point 34, to which pressure connection the corresponding air connection docks for a short time as it passes.

In the further course, the vacuum in the downstream air circuits (e.g., the second air circuit 54.2 and any further downstream air circuits passing the transfer point 34) is destroyed at intervals.

Accordingly, the separating device 10 is configured, in particular by programming with a corresponding computer program stored in the memory 32, to perform a separating process for separating flat workpieces 12 from a material web 14, which process comprises the following steps:

a) providing the material web 14, b) picking up the material web 14 with a plurality of the workpiece carriers 26 successively moved in a transport direction, wherein vacuum is first applied to a movable suction nozzle 42.1 which is leading in the transport direction and then vacuum is applied to a movable suction nozzle 42.2 which is trailing in the transport direction, c) transporting the workpiece carriers 26 with the material web 14 sucked to them through the cutting device 18 and cutting the material web 14 between two successive workpiece carriers 26 in order to separate segments of the material web 14 lying on the workpiece carriers 26 to form workpieces 12;

d) transferring the workpieces 12 to the rotating vacuum drum 22 for removal, wherein first a movable suction nozzle 42.1 which is leading in the transport direction is switched to a vacuumless state and then a movable suction nozzle 42.2 which is trailing in the transport direction is switched to a vacuumless state.

In preferred embodiments, step d) comprises one or more of the following steps:

d1) counter-blowing by the suction nozzle 42.1, 42.2 switched to the depressurized state, in order to shorten the transfer time for transferring the workpiece 12;

d2) applying the workpiece 12 against the vacuum roller 22 using the force holding the respective suction nozzle 42, 42.1, 42.2 in the rest position as a restoring force; and/or d3) applying a restoring force of the respective suction nozzle 42, 42.1, 42.2 to the workpiece 12 to urge it against the vacuum roller 22 in order to prevent a loss of position during transfer.

The arrangement shown in FIG. 1 enables a continuous process and material flow as well as an intermittent material flow.

FIG. 2 shows a lateral view of the workpiece carrier 26 (here with the carrier body 36 in the form of a cassette). The at least two air circuits 54.1, 54.2 shown schematically in FIG. 2 are integrated into the base body—carrier body 36—of the workpiece carrier. The movable suction nozzles 42, 42.1, 42.2 are connected to these separately controllable air circuits 54.1, 54.2 as suction nozzles 56.1, 56.2.

FIG. 3 shows a sectional view of the workpiece carrier 26 with the vacuum activated.

When the vacuum is activated, the suction nozzles 42.1, 42.2 retract to an extent when a workpiece 12 is placed on them, such that they form a flat surface with the workpiece carrier 26. In this manner, the workpiece 12 can be sucked without damage.

FIG. 4 shows a top view of the workpiece carrier 26. A possible arrangement of movable suction nozzles 42, 42.1, 42.2 is shown. These are divided into several air circuits 54.1, 54.2 and can be controlled separately.

The systems and devices described herein may include a controller or a computing device comprising a processing and a memory which has stored therein computer-executable instructions for implementing the processes described herein. The processing unit may comprise any suitable devices configured to cause a series of steps to be performed so as to implement the method such that instructions, when executed by the computing device or other programmable apparatus, may cause the functions/acts/steps specified in the methods described herein to be executed. The processing unit may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory may be any suitable known or other machine-readable storage medium. The memory may comprise non-transitory computer readable storage medium such as, for example, but not limited to, an electronic, magnetic, optical, electromagnetic, infrared, or semiconductor system, apparatus, or device, or any suitable combination of the foregoing. The memory may include a suitable combination of any type of computer memory that is located either internally or externally to the device such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. The memory may comprise any storage means (e.g., devices) suitable for retrievably storing the computer-executable instructions executable by processing unit.

The methods and systems described herein may be implemented in a high-level procedural or object-oriented programming or scripting language, or a combination thereof, to communicate with or assist in the operation of the controller or computing device. Alternatively, the methods and systems described herein may be implemented in assembly or machine language. The language may be a compiled or interpreted language. Program code for implementing the methods and systems described herein may be stored on the storage media or the device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein.

Computer-executable instructions may be in many forms, including modules, executed by one or more computers or other devices. Generally, modules include routines, programs, objects, components, data structures, etc., that perform particular tasks or implement particular abstract data types. Typically, the functionality of the modules may be combined or distributed as desired in various embodiments.

It will be appreciated that the systems and devices and components thereof may utilize communication through any of various network protocols such as TCP/IP, Ethernet, FTP, HTTP and the like, and/or through various wireless communication technologies such as GSM, CDMA, Wi-Fi, and WiMAX, is and the various computing devices described herein may be configured to communicate using any of these network protocols or technologies.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE SIGNS

10 separating apparatus
12 workpiece
14 material web
16 feeding device
18 cutting device
20 transport device
22 vacuum drum
24 transport system
26 workpiece carrier
28 controller
30 processor
32 memory
34 transfer point
36 carrier body
38 support surface
40 suction device
42 suction nozzle
42.1 first suction nozzle
42.2 second suction nozzle
44 nozzle opening
46 boundary
48 force accumulator
50 diaphragm spring
52 gasket
54.1 first air circuit
54.2 second air circuit
56.1 first intake nozzle
56.2 second intake nozzle
58.1 first air chamber
58.2 second air chamber
60 transfer point
62 plug-in nipple
64 vacuum bore
66 substructure
68 vacuum pump
70.1 first valve
70.2 second valve
70.3 third valve
70.4 fourth valve

The invention claimed is:

1. A workpiece carrier for taking over, transporting and transferring a workpiece formed as a segment of a material web, the workpiece carrier comprising:

a support surface formed on a carrier body for placing the workpiece on, and a suction device for sucking the workpiece onto the support surface, the suction device having at least one movable suction nozzle which protrudes from the support surface in a rest position and, when subjected to vacuum, is configured to be moved against a force holding the at least one movable suction nozzle in the rest position into a retracted position in which the at least one movable suction nozzle does not protrude beyond the support surface, wherein the suction device has at least one first air circuit with at least one first suction nozzle for sucking the workpiece onto the support surface and a second air circuit with at least one second suction nozzle for sucking the workpiece onto the support surface, wherein the first and second air circuit are configured to be controlled differently.

2. The workpiece carrier according to claim 1, wherein that the at least one first suction nozzle is designed as a first movable suction nozzle, or wherein the at least one second suction nozzle is designed as a second movable suction nozzle, or both.

3. The workpiece carrier according to claim 1, wherein the at least one first suction nozzle is arranged upstream of the at least one second suction nozzle in a transport direction.

4. The workpiece carrier according to claim 1, wherein the first air circuit has a first air chamber in the carrier body, and at least one first movable suction nozzle connected to the first air chamber, and wherein the second air circuit has a second air chamber in the carrier body and at least one second movable suction nozzle connected to the second air chamber.

5. The workpiece carrier according to claim 4, wherein the first air chamber has a first air connection at a side or on a side of the carrier body opposite the support surface and the second air chamber has a second air connection at a side or on a side of the carrier body opposite the support surface.

6. The workpiece carrier according to claim 1, wherein air connections of the first and second air circuits are offset relative to each other in a transport direction.

7. The workpiece carrier according to claim 1, wherein the workpiece carrier is configured as a transport unit of a transport system with individually movable transport units.

8. A transport system comprising:

a guide track and a plurality of workpiece carriers according to claim 1, the workpiece carriers individually movable along the guide track as transport units.

9. A device for separating flat workpieces from a material web, comprising:

a feeding device for feeding a material web, a cutting device for cutting the material web to obtain workpieces, a vacuum drum for removing the workpieces, and a plurality of the workpiece carrier according to claim 1.

10. A method for separating flat workpieces from a material web, the method comprising:

a) providing a material web, b) picking up the material web with a plurality of workpiece carriers moved successively in a transport direction according, each workpiece carrier comprising a support surface formed on a carrier body for placing the workpiece on, and a suction device for sucking the workpiece onto the support surface, the suction device having at least one movable suction nozzle which protrudes from the support surface in a rest position and, when subjected to vacuum, is configured to be moved against a force holding the at least one movable suction nozzle in the rest position into a retracted position in which the at least one movable suction nozzle does not protrude beyond the support surface, wherein first a movable suction nozzle which is leading in a transport direction is subjected to vacuum and then a movable suction nozzle which is trailing in the transport direction is subjected to vacuum, c) transporting the workpiece carriers having the material web sucked to them through a cutting device and cutting the material web between two successive workpiece carriers in order to separate segments of the material web lying on the workpiece carriers to form workpieces; and, d) transferring the workpieces to a vacuum drum for removal, wherein first a movable suction nozzle which is leading in the transport direction is switched to a vacuumless state and then a movable suction nozzle which is trailing in the transport direction is switched to a vacuumless state.

11. The method according to claim 10, wherein step d) comprises at least one or more of the following steps:

d1) counter-blowing by the at least one movable suction nozzle switched to a vacuumless state in order to shorten the transfer time for transferring the workpiece;

d2) applying the workpiece against the vacuum drum using the force holding the respective suction nozzle in the rest position as a restoring force; and, d3) applying a restoring force of the respective suction nozzle to the workpiece to urge the workpiece against the vacuum roller to prevent a loss of position during transfer.

12. A non-transitory computer readable medium storing a computer program comprising instructions which cause a device to perform the method according to claim 10.

13. A device for separating flat workpieces from a material web, comprising:

a feeding device for feeding a material web, a cutting device for cutting the material web to obtain workpieces, a vacuum drum for removing the workpieces, and a plurality of the workpiece carriers, each workpiece carrier of the plurality of workpiece carriers comprising a support surface formed on a carrier body for placing a workpiece on, and a suction device for sucking the workpiece onto the support surface, the suction device having at least one movable suction nozzle which protrudes from the support surface in a rest position and, when subjected to vacuum, is configured to be moved against a force holding the at least one movable suction nozzle in the rest position into a retracted position in which the at least one movable suction nozzle does not protrude beyond the support surface.

* * * * *